United States Patent [19]

Adell

[11] Patent Number: 4,955,393

[45] Date of Patent: Sep. 11, 1990

[54] MOUTHGUARD WITH CONFORMABLE ARCH LINERS

[75] Inventor: Loren S. Adell, Dallas, Tex.

[73] Assignee: Trident Laboratories, Inc., Sunnyvale, Tex.

[21] Appl. No.: 176,046

[22] Filed: Mar. 30, 1988

[51] Int. Cl.[5] ..... A61F 5/56

[52] U.S. Cl. ..... 128/859; 128/861; 128/862

[58] Field of Search ..... 128/136, 859–862; 433/33, 34

[56] References Cited

U.S. PATENT DOCUMENTS

| | | | |
|---|---|---|---|
| 3,073,300 | 1/1963 | Berghash | 128/136 |
| 3,096,761 | 7/1963 | Moffett | 128/136 |
| 3,223,085 | 12/1965 | Gores et al. | 128/136 |
| 3,505,995 | 4/1970 | Greenberg | 128/136 |
| 3,864,832 | 2/1975 | Carlson | 128/136 |
| 4,173,219 | 11/1979 | Lentine | 128/136 |
| 4,338,928 | 7/1982 | Martin et al. | 128/136 |
| 4,569,342 | 2/1986 | von Nostitz | 128/136 |
| 4,718,662 | 1/1988 | North | 128/136 |

*Primary Examiner*—Robert A. Hafer
*Assistant Examiner*—Michael Brown
*Attorney, Agent, or Firm*—George L. Boller

[57] ABSTRACT

A mouthguard that has a body having upper and lower troughs conforming generally to the upper and lower arches. Liners of impression material are disposed in the respective troughs for conformance to the actual impressions of the teeth of the arches. The body has an occlusal wall that contains a series of spaced-apart air/-saliva ducts extending in a lingual/buccal sense to establish lingual/buccal fluid communication. The liners are mechanically interlocked to the mouthguard body by interlocking material that extend along the edges of the respective troughs and also by integral connections which extend through the occlusal wall between the two troughs in bridging portions of the occlusal wall that separate the air/saliva ducts.

10 Claims, 2 Drawing Sheets

MOUTHGUARD WITH CONFORMABLE ARCH LINERS

BACKGROUND AND SUMMARY OF THE INVENTION

This invention relates generally to mouthguards, or mouth protectors. More specifically, it relates to a new and improved mouthguard that has a body whose shape corresponds generally to that of the upper and lower arches but which contains impression, or formfit, material that serves to fully conform to the actual impressions of the upper and lower arches.

One of the common uses of mouthguards is in contact sports activity where a participant may be subject to impacts that could at times be sufficiently severe to loosen or even dislodge one or more teeth. In some activities, the use of mouthguards is mandated while in others, it is optional. While mouthguards are considered useful in protecting teeth, the use of any particular mouthguard is not a guarantee that injury will be avoided in all cases.

There are different varieties of mouthguards that are presently available on the commercial market. In general, they are mass produced and come in a limited number of size ranges, often containing instructions for cutting a manufactured size to a shape to more closely fit a particular individual. As such, these mouthguards are not manufactured to conform to the actual teeth impressions of any particular individual.

One type of such commercial mouthguards comprises the use of a material which can be more or less softened by immersion in hot water. When the softened mouthguard is then placed in the mouth and the individual bites onto it, a limited impression of the occlusal surfaces of the teeth of the respective arches may result. In other words, it is only the occlusal surfaces of the mouthguard that provide any conformance at all to the teeth of the arch and conformance of lingual and buccal surface of the mouthguard to the lingual buccal and interproximal regions of the teeth is not achieved. It is recognized that this type of mouthguard fails to provide as great a degree of protection as a custom-fitted mouthguard, but it is fairly inexpensive and can provide some benefit.

A custom-fitted mouthguard is available usually only through a dentist, who takes actual full impressions of the upper and lower arches. The mouthguard is then fabricated by usual procedures from these impressions. While this mouthguard provides a fuller degree of protection, it is considerably more expensive than the mouthguards that are typically mass produced and sold commercially in athletic stores, variety stores and the like.

The present invention is directed to a new and improved mouthguard which is suited for mass production, yet can provide a greater degree of conformance to individual teeth of the arches including not only the occusal surfaces, but the lingual surfaces, buccal surfaces and interproximal regions as well. As such, the invention provides an edge guard which can be manufactured at reasonable cost so as to be mass produced and marketed in athletic stores, variety stores and the like, yet which can provide many of the benefits that are attainable with much more expensive custom-made mouthguards.

Briefly, the invention in its presently preferred embodiment comprises a one-piece body that has a shape that corresponds generally to the upper and lower arches but contains upper and lower liners of impression material that is adapted, when placed in the user's mouth, to more closely conform to actual impressions of the teeth of the arches such that the arches, including occlusal, lingual, buccal surfaces, and interproximal regions, are provided with an improved degree of protection. With the selection of suitable impression materials, arch conformance can be achieved at normal body temperatures so that procedures such as the soaking of the mouthguard in hot water beforehand are unnecessary. Moreover, by attention to particular details in the relative proportions of the accommodations in the one piece mouthguard body for the impression material, and the selection and arrangement of the impression material in these accommodations, teeth of the arch can be protected not only just along the occlusal surfaces but along significant portions of the lingual and buccal surfaces of the teeth including the interproximal regions, even to the gingiva.

The impression material is intended to be permanently joined to the mouthguard body by means of mechanical and/or chemical bonding and certain aspects of the invention relate to the manner of such joining. Hence, many of the benefits of a custom mouthguard can be provided in a relatively low cost, mass-produced mouthguard, in accordance with the invention.

A still further feature of the invention is that the basic mouth guard body contains lingual/buccal ducts that provide for fluid communication between lingual and buccal regions of the mouth. This is important when the mouthguard is in use because such ducts can facilitate flow of air and/or saliva.

In addition to details of the preferred embodiment of mouthguard which will be illustrated in the drawings, there will also be described certain details of the methods for making and using the mouthguards.

The foregoing features, advantages and benefits of the invention, along with additional ones will be seen in the ensuing description and claims which should be considered in conjunction with the accompanying drawings. The drawings disclose a presently preferred embodiment of mouthguard according to the best mode contemplated at the present time in carrying out the invention as to details of the mouthguard itself, its method of manufacture, and its use.

DESCRIPTION OF THE PREFERRED EMBODIMENT

Figure 1:
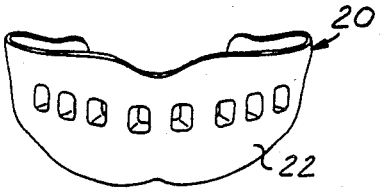
FIG. 1 is a front perspective view of a mouthguard embodying principles of the invention.
Figure 2:
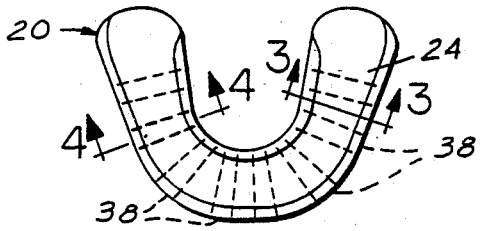
FIG. 2 is a top plan view of the mouth guard of FIG. 1.
Figure 3:
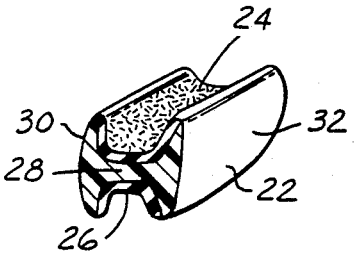
FIG. 3 is a perspective view looking generally in the direction of arrow 3 in FIG. 2.

FIGS. 1–5 illustrate a first embodiment of mouthguard 20 according to principles of the invention. The mouthguard comprises a body 22 whose shape corresponds generally to that of the upper and lower arches. Disposed on body 22 are liners of impression material 24, 26, respectively, for the upper and lower arches.

Body 22 may be considered to comprise an occlusal wall 28 that bridges intermediate portions of a lingual wall 30 and a buccal wall 32. As such, body 22 forms an upper trough 34 for the upper arch and a lower trough 36 for the lower arch. The respective liners of impression material 24, 26 are disposed in the respective troughs 34, 36.

The impression material that comprises liners 24 and 26 is sufficiently pliable to enable it to conform to the actual impression of the arches when mouthguard 20 is placed in the mouth and bitten upon. The occlusal surfaces of the teeth exert forces toward the occlusal wall 28 and the impression material conforms in such a manner that the liners are also caused to have impressions of the lingual and buccal surfaces of the teeth of the arches, including the interproximal regions, whereby an actual impression of the teeth of the arch is obtained in each liner.

The occlusal wall 28 provides support for the occlusal portions of the impressions while the lingual and buccal walls provide support of the impression material for obtaining the impressions of the lingual and buccal surfaces of the teeth of the arches including the interproximal regions. The drawings are representative and it is to be appreciated that the actual amount of impression material that is disposed in a trough is in a suitable amount and arrangement in the trough so that the desired impressions are obtained. The particular mouthguard 20 has an anterior-posterior extent sufficient for the full upper and lower arches.

A further feature of mouthguard 20 resides in the inclusion of air/saliva ducts 38 that extend through the three walls 28, 30, and 32 between the exterior buccal surface 40 and the exterior lingual surface 42. Ducts 38 provide fluid communication between lingual and buccal regions of the mouth that are beneficial for conveyance of air and/or saliva when the mouthguard is in use. This is a convenience in promoting comfort to the user. The embodiment of mouthguard 20 contains a number of such ducts 38 distributed around the extent of the mouthguard. It is to be understood that this is merely a representative illustration and that the size, shapes and numbers of such ducts may be selected as desired for any particular mouthguard.

Figure 4:
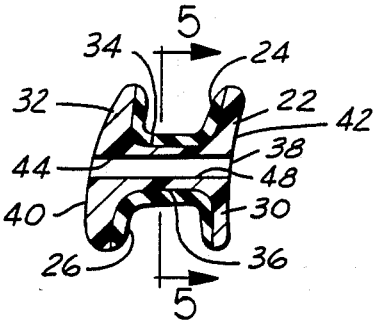
FIG. 4 is an enlarged transverse cross sectional view taken generally in the direction of arrows 4—4 in FIG. 2.
Figure 5:
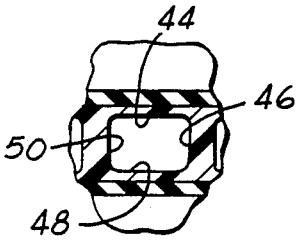
FIG. 5 is a cross sectional view taken generally in the direction of arrows 5—5 in FIG. 4.

As can be seen in FIGS. 4 and 5, each duct 38 is bounded by four wall surface portions 44, 46, 48 and 50. These wall surface portions are in fact part of the occlusal wall 28 but they extend through the lingual and buccal walls 30 and 32 to the exterior surfaces 40 and 42. Depending upon the particular nature of material used for body 22 and the relative proportions of the ducts and walls, the occlusal wall 28 may be subject to a certain amount of collapse when the mouthguard is bitten. The amount of such collapse may be controlled according to the particular design of the mouthguard. It is desirable, however, that full collapse be avoided because that would then block the ducts, thereby defeating their intended purpose.

Figure 6:
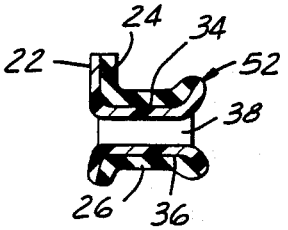
FIGS. 6–11 are transverse cross sectional views similar to the view of FIG. 4 illustrating different transverse cross sections.

FIG. 6 illustrates a transverse cross section 52 through a mouthguard in which like reference numerals are used to designate parts that correspond to those parts already identified for mouthguard 20. The principal difference in the transverse cross section of FIG. 6 resides in the relative proportions. The lower trough 36 is generally shallower while in the upper trough the lingual wall is shorter than the buccal wall. The impression material liners 24 and 26 line the full extent of the trough as in mouthguard 20.

Figure 7:
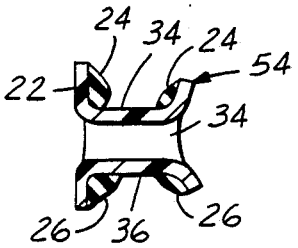

FIG. 7 illustrates a further cross section 54 and its several parts are identified by numerals corresponding to those already used in connection with the parts of mouthguard 20. In certain respects, the body of cross section 54 is similar to that of cross section 52 of FIG. 6. The primary difference between cross section 54 and cross section 52 is that the impression material liners do not line the full extent of either trough 34 or 36 in FIG. 7. Liner material is applied generally in the corners of the troughs so that a central region of the occlusal wall is void of impression material. This enables the user to bite directly into the occlusal wall material, but there is a sufficient amount of impression material suitably organized and arranged in the respective troughs so that the impression material still conforms to the lingual and buccal surfaces of the teeth of the arches, including the interproximal regions. Once again, the particular amount and disposition of impression material in any given mouthguard is designed to provide a desired degree of contact with the teeth of the arch.

Figure 8:
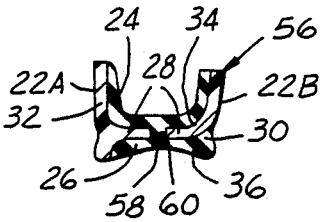

FIG. 8 illustrates another transverse cross section 56 in which the reference numerals correspond to those previously used for corresponding parts of mouthguard 20. In the cross section of FIG. 8, the mouthguard body 22 comprises two separate parts 22A and 22B. The part 22A contains the buccal wall 32 and an adjoining portion of the occlusal wall 28. The part 22B contains the lingual wall 30 and an adjoining portion of the occlusal wall 28. Thus, the two portions of the occlusal wall 28A, 28B are separated by a small gap 58.

In the embodiment of FIG. 8, the liner is one piece still comprising the upper and lower troughs conforming to the upper and lower troughs 34, 36 cooperatively defined by the two body parts 22A and 22B, but the central regions of the occlusal surface portions of the upper and lower impression material liners 24, 26 are joined by an integral connection 60 that passes through gap 58. In this embodiment, the impression material fills both of the troughs 34 and 36 although the lower trough 36 is illustrated as being somewhat shallower than the upper trough 34. Although not specifically illustrated by FIG. 8, it is possible that the body 22 could be of one piece construction rather than two separate pieces by having bridging portions spanning gap 58 at certain intervals around the mouthguard. In such an embodiment, the gap 58 would not be a continuous gap extending fully around the mouthguard but rather would be a series of individual gaps, or apertures, that are separated by the bridging portions.

Figure 9:
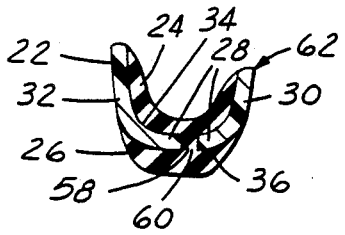

FIG. 9 illustrates a further cross section 62 in which like reference numerals are used to designate parts that have been identified in previous drawing figures. The cross section of FIG. 9 is basically similar to that of FIG. 8 except that the lingual and buccal walls are omitted from the lower trough 36. The impression material, however, still is fully disposed in covering relation to the lower side of the occlusal wall 28 so that it will receive the impression of the lower teeth when the mouthguard is put to use. The embodiment of FIG. 9 is illustrated as comprising for body 22 the two-part construction 22A, 22B with the one part liner comprising the integral connection 60 passing through gap 58. It is to be appreciated that in a modified form of FIG. 9 (not illustrated), gap 58 could be made a series of shorter gaps rather than one continuous gap, by the inclusion of bridging portions spaced apart around the mouthguard body.

Figure 10:
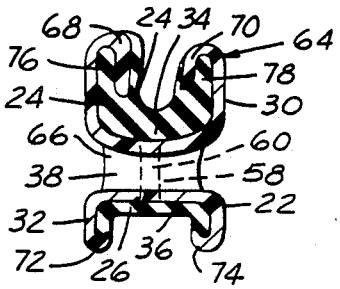

FIG. 10 illustrates a further transverse cross section 64 of mouthguard in which like reference numerals are used to designate corresponding parts from the previous views. The cross section 64 is perhaps most similar to the cross sections that are illustrated in FIGS. 4 and 6. It differs however in that it comprises a series of integral connections 60 for joining the upper impression material liner 24 with the lower impression material liner 26. The embodiment 64 is a cross section of a mouthguard that incorporates ducts 38 and the gaps 58 are formed as passages which extend through the bridging portions 66 that separate adjacent ducts 38.

Hence, the upper and lower impression material liners are integrally joined by a series of integral connections 60 passing through the series of gaps 58.

Moreover the liners are interlocked in the respective troughs through the use of interlocking lips 68, 70 in the case of the upper trough and lips 72, 74 in the lower trough. The upper trough lips 68 and 70 comprise crevices 76, 78 within which some of the impression material is disposed. There is also impression material on the opposite side of each lip where the teeth of the arch are disposed when the mouthguard is put to use. In the case of the lower trough lips 72 and 74, the lips simply overhang the edges of the impression material liner.

Figure 11:
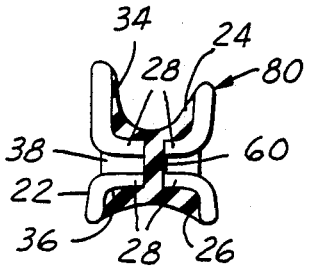

FIG. 11 represents a further transverse cross section 80 that is similar to the cross section of FIG. 10 except that it omits the lips 68, 70, 72, and 74.

Figure 12:
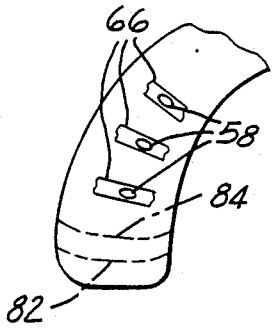
FIG. 12 is a partial top view of a posterior portion of a mouthguard.

FIG. 12 is a fragmentary plan view of a posterior portion of one side of a mouthguard which illustrates the layout of the ducts 38 and the gaps 58. It also shows two dot dash lines 82 and 84, respectively, which are intended to illustrate where a mouthguard, as manufactured, may be cut if, as manufactured, it has too great a posterior extent to fit a particular arch. Cutting across the line 80 will remove the posterior portion and cutting along the line 82 will remove an even larger portion.

Figure 13:
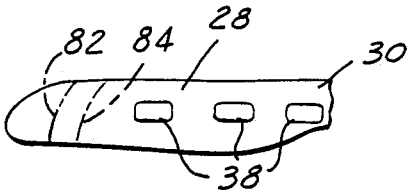
FIG. 13 is a lingual view of FIG. 12.

FIG. 13 is a lingual view also illustrating the two lines of cutting 82 and 84.

Figure 14:
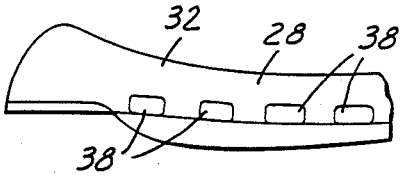
FIG. 14 is a buccal view of a mouthguard.

FIG. 14 is a buccal view of another embodiment of mouthguard in which like reference numerals are used to designate corresponding parts previously described in earlier drawing figures. This embodiment shows that the upper trough may extend the full extent of the arch whereas the lower trough will have lingual and buccal walls only along posterior segments of the mouthguard. In other words, the lower trough comprises only the occlusal wall alOng an anterior portion.

Mouthguards embodying the present invention may be fabricated using any conventional impression material for the liners; for example, urethanes, silicones, or certain types of vinyl are suitable. The body is also of any conventional mouthguard material but, in general, it will be less resilient and less pliable than the impression material of the liners. Here again, the body may be fabricated of materials compatible with the liner and compatible adhesives used to secure the liner and the mouthguard body together as required.

One of the potential drawbacks of using adhesive alone is that the materials must be FDA approved and those adhesives which are currently FDA approved are often lacking in sufficient strength and durability. This is where the invention provides an advantage because of the interlocking features of the liner with the mouthguard body, for example, with reference particularly to FIGS. 8–12. By providing mechanical interlocks resulting from the particular organization and arrangement of the liners and the mouthguard body, rather than depending on adhesive alone, the potential difficulties which may result from adhesive loosening will be less significant. It is contemplated that a suitable mouthguard comprising the liners and body could be fabricated without use of any adhesive at all but in general it is contemplated that some adhesive may be required. The advantage, once again however, is that the mechanical interlocking features render the liner less susceptible to separation from the mouthguard body due to failure of adhesives.

It is also contemplated that a technique such as shuttle molding may be used for fabricating the mouthguard so that the liner and mouthguard body can intimately bond together during the fabrication process without the use of individually fabricating the liners and mouthguard body and then assembling them together. The concept of shuttle molding is that, for example, the liner is molded to the body of the mouthguard shortly after the mouthguard has been fabricated and while it is still warm.

Another aspect of the invention comprises the use of a different class of materials for the mouthguard body. These materials comprise a different procedure for securing conformance to the person's arches. Such materials are referred to as moisture-cured materials, and moisture-cured polyurethane is a suitable example of such a material for use in the present invention. When the material is uncured, it is in a somewhat gel-like state.

The mouthguard can be manufactured to the aforementioned constructions using such material, but at the conclusion of manufacture, it is promptly packaged into a hermetically sealed (i.e. vacuum-packed), sterile, moisture-proof package. In such an environment the material of the mouthguard material remains formable because it is still uncured. Mouthguards packaged in this way are shipped through commercial avenues until ready to be put to use by the individual. For example, it is contemplated that the mouthguards could be packed in suitable packaging, similar to blister-packing, for store merchandising as consumer items.

When the packaged mouthguard is to be used, the person opens the package, removes the mouthguard, and places it in his or her mouth. Since the body of the mouthguard material is of course still formable at this stage, it will form to the impressions of the individual's arches when the individual bites onto it. Due to the presence of water in mouth saliva, the material can begin to cure to a stabilized form. However, after suitable forming, it can be removed from the mouth and placed in water to complete the curing process. Hence, this process is somewhat the opposite of that previously described, insofar as the manner of curing is concerned. The foregoing disclosure has described principles of the invention. These principles may be implemented in various specific embodiments of mouthguards and while a preferred embodiment has been illustrated and described, it will be appreciated that principles of the invention will extend to embodiments other than those which have been specifically illustrated.

What is claimed is:

1. A mouthguard preform comprising a body having at least one trough for an arch, liner material disposed in said trough for securing an impression of the teeth of the arch when deformed by said teeth and thereby conforming the mouthguard to the teeth of the arch when the preform subsequently becomes a usable mouthguard; and joining means joining the liner material to said body comprising mechanical interlocking means for mechanically interlocking the liner to the body, in which said interlocking means is disposed at the occlusal wall of the trough and comprises material integral with said liner which extends through one or more apertures through said occlusal wall and interlocks with the side of the occlusal wall opposite the side containing said trough both before and after the teeth of the arch are impressed in said liner material, said joining means further comprising the liner material being directly molded onto said body and extending through said apertures and engaging the opposite side of said occlusal wall while in its undeformed state.

2. A mouthguard preform as set forth in claim 1 in which said material, after extending through said one or more apertures through said occlusal wall to interlock with the side of the occlusal wall opposite said trough, also forms on said opposite side of said trough, another liner for the other arch.

3. A mouthguard preform as set forth in claim 2 in which said body includes a further trough on said opposite side of the occlusal wall relative to the first-mentioned trough, said further trough being a trough for said another liner.

4. A mouthguard preform as set forth in claim 3 in which said interlocking means further comprises lips that extend along buccal and lingual edges of said further trough.

5. A mouthguard preform as set forth in claim 1 in which said material extends through a series of spaced apart apertures through said occlusal wall.

6. A mouthguard preform as set forth in claim 1 in which said body comprises lingual/buccal ducts extending in a lingual/buccal sense through the occlusal wall to provide lingual/buccal communication, and said one or more apertures are in spaced-apart bridging portions of said body that separate said lingual/buccal ducts.

7. In a mouthguard comprising a body that has a lingually disposed portion, a buccally disposed portion, and an occlusal wall which is disposed between said two portions and which is adapted to be bitten upon by the teeth the improvement comprising one or more air/saliva ducts passing completely horizontally from said lingually disposed portion through the occlusal wall to said buccally disposed portion to establish a lingual/buccal communication for the user of the mouthguard when the mouthguard is in use.

8. A mouthguard as set forth in claim 7 in which said one or more air/saliva ducts comprise a series of spaced-apart ducts which extend around the mouthguard body and which are separated by bridging walls in the mouthguard body.

9. A mouthguard as set forth in claim 8 in which at least some of said bridging walls contain apertures extending through the occlusal wall and containing material for interlocking to said body a liner that is disposed on one side of the occlusal wall.

10. A mouthguard as set forth in claim 9 in which said material serves to connect said liner with a further liner that is disposed on the opposite side of the occlusal wall.

* * * * *